US005901384A

United States Patent [19]

Sim

[11] Patent Number: 5,901,384

[45] Date of Patent: May 11, 1999

[54] TOILET ASSEMBLY HAVING AUTOMATIC FLUSHING SYSTEM

[76] Inventor: Jae K. Sim, 3 Mint Glade, Irvine, Calif. 92604

[21] Appl. No.: 08/984,972

[22] Filed: Dec. 9, 1997

Related U.S. Application Data

[60] Provisional application No. 60/043,006, Apr. 14, 1997.

[51] Int. Cl.[6] ..... E03D 1/00

[52] U.S. Cl. ..... 4/313; 4/302; 4/304; 4/DIG. 3; 4/406

[58] Field of Search ..... 4/313, 405, 406, 4/302, 304, 305, 242.1, 245.1, DIG. 3; 307/116, 117; 327/514, 515; 250/221

[56] References Cited

U.S. PATENT DOCUMENTS 5,003,643 4/1991 Chung ..... 4/313
5,353,443 10/1994 Sim ..... 4/216
5,455,971 10/1995 Sakakibara et al. ..... 4/313
5,603,127 2/1997 Veal ..... 4/313

*Primary Examiner*—David J. Walczak
*Assistant Examiner*—Tuan N. Nguyen

[57] ABSTRACT

A toilet assembly having an automatic flushing system comprising a toilet bowl having a toilet cover, the toilet cover containing a window disposed therein, a water holding tank operatively associated with the toilet bowl, the holding tank containing structures for storing water, discharging water into the toilet bowl and a replenishing water to the water holding tank, and motion sensing device positioned within the water holding tank and aligned with the window in the toilet cover, when the toilet cover is in a raised position, the motion sensing device being angled in a downward direction from the horizontal, so that any reflection of beams from the motion sensing device against the window in the toilet cover is not received by the motion sensor and thus does not activate the motion sensor.

7 Claims, 3 Drawing Sheets

13
50
21
23
27
20
28
22
25
13'
26
29
12
18
17
10
16
19
19'
15
45
11
14
47
48
33
34
36
35
44
42
30
40
43
41
49
39
31
38
32
37

TOILET ASSEMBLY HAVING AUTOMATIC FLUSHING SYSTEM

This application claims the benefit of U.S. Provisional Application 60/043,006, filed Apr. 14, 1997.

BACKGROUND OF THE INVENTION

1. Field of the Invention

The present invention relates to a toilet assembly having a flushing system and more particularly to a toilet assembly containing a motion sensor member and a lifting mechanism disposed in the water holding tank of a toilet whereby when the user separates from the toilet, the toilet is automatically flushed.

2. Description of Related Art

Various types of toilet assemblies having an automatic flushing system are generally known in the art. Such assemblies are known to utilize a sensor for flushing fresh flush water through a plurality of openings. Generally, a sensor device for automatic flushing systems for a toilet assembly is fixed on a wall which is located on the back side of the toilet assembly or attached to the water pipe for the toilet assembly.

However, the sensor device for such conventional automatic flushing systems for a toilet assembly suffer from a number of problems. For example, since the sensor device of such conventional automatic flushing systems are built in a wall or on a water pipe located at the back side of the toilet assembly, the installation cost is high and it is difficult to repair when maintaining the system. Also, since there is no manual system to complement the automatic system, if the sensor device is out of order, the toilet becomes inoperative. In addition, the sensor device of such conventional automatic flushing systems is expensive.

In order to avoid these problems, U.S. Pat. No. 5,353,443, issued to the present inventor, was obtained which discloses a toilet assembly having a combined automatic ventilation and flushing system, which comprises a returnable solenoid member, a trap way, a trap way valve member, a multifunctional tube member, and a motion sensor whereby while the user sits on the toilet seat, the objectionable odor is effectively ventilated and when the user stands up, the toilet assembly is automatically flushed. However, this toilet assembly does not achieve a perfect discharge of the flush water and is somewhat complicated in construction.

SUMMARY OF THE INVENTION

Accordingly, it is an object of the present invention to provide a toilet assembly having an automatic flushing system, which eliminates the above problems encountered with conventional toilet assemblies having an automatic flushing system.

Another object of the present invention is to provide a toilet assembly having an automatic flushing system which includes a motion sensor device disposed on the front interior or the water holding tank, and a lifting device disposed in the water holding tank whereby after the user removes himself from the toilet and toilet assembly, the toilet is flushed automatically.

A further object of the present invention is to provide a toilet assembly having an automatic flushing system which is effective for use by handicapped people and senior citizens. Thus, because elderly or weaker people experience some difficulty in pushing the flush button of a toilet assembly and also, since most flush push buttons for toilets located in public areas become dirty, the toilet assembly of the present invention is particularly effective.

Still another object of the present invention is to provide a toilet assembly which includes an inexpensive motion sensor member which utilizes a battery as a source of electrical power.

An additional object of the present invention is to provide an automatic flushing system which is combined with a manual flushing system.

Yet another object of the present invention is to provide a toilet assembly which includes a lifting lever member which can maintain the flapper valve in an open portion for a certain period of time, such as for example, five seconds, so that the flush water in the water holding tank is discharged, but at the same time some of the flush water in the tank is retained, thereby economizing on water usage.

Another object of the present invention is to provide a toilet assembly having an automatic flushing system which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a toilet assembly having an automatic flushing system which includes a motion sensor member and a lifting mechanism connected to the motion sensor member whereby when the user uses the toilet assembly and then moves away from the toilet assembly, the toilet assembly is flushed automatically.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figures 1, 2:
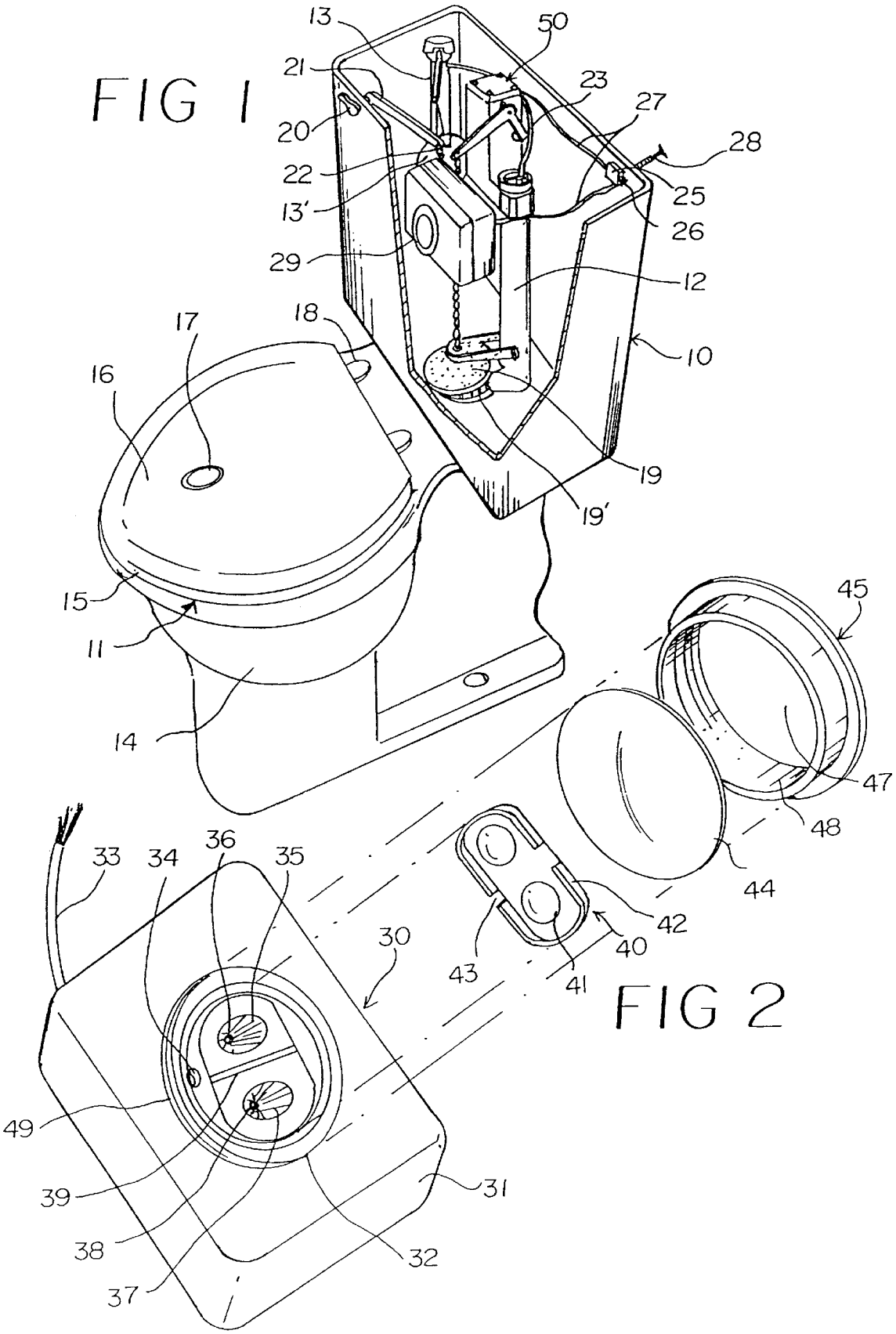
FIG. 1 is a perspective view of a toilet assembly having an automatic flushing system according to the present invention, containing cut-away portions in order to illustrate the construction of the toilet assembly of the present invention.
FIG. 2 is an exploded perspective view of a motion sensor member disposed on the front interior of the water holding tank according to the present invention.

Referring now in detail to the drawings for the purpose of illustrating preferred embodiments of the present invention, the toilet assembly having an automatic flushing system as shown in FIGS. 1 to 5, includes a toilet water holding tank 10, a toilet stool 11, a multifunctional overflow tube 12 and a water supply tube 13, the latter two being disposed in the toilet water holding tank 10. A sensor 29 of a motion sensor member 30 is disposed on the front interior wall of the water holding tank 10, and a lifting member 50 is disposed in the water holding tank 10.

The toilet stool 11 includes a toilet bowl 14, a seat ring 15 operatively located on the top of the toilet bowl 11, and a toilet seat cover 16 having a sensor aperture (window) 17 positioned in the seat cover 16. The toilet seat cover 16 is pivotally connected to the seat ring 15 by a pair of pivotal hinges 18. Generally, the toilet stool 11 is the same as a conventional stool of a toilet assembly.

The toilet water holding tank 10 contains the water to be flushed into the toilet bowl 14 through a main tunnel 19' of the toilet stool 11. A float member 13' and a water hose 23 are connected to the water supply tube 13, and a manual flush push button 20 is disposed on the front exterior wall thereof for connection to a flapper valve 19 through a rod 21 and a chain 22. The water supply tube 13 stands upright within the toilet water holding tank 10.

As shown in FIG. 2, the motion sensor member 30 includes a housing 31 having a neck member 32 with a screw neck 49 for engaging with a screw cover 48 of a ring cover 45. A right recess chamber 35 contains a sending eye 36 and a left recess chamber 37 contains a receiving eye 38. A partition 39 is disposed between the right and left chambers 35 and 37, and the sensor also contains a working indicator 34 with associated electrical wires 33. The motion sensor member 30 further includes a lens member 40 having a pair of convex lenses 41, a pair of side walls 42, a pair of slits 43 for engaging with the partition 39, and a circular plate 44 inserted into the aperture 47 of the ring cover 45.

Figure 3:
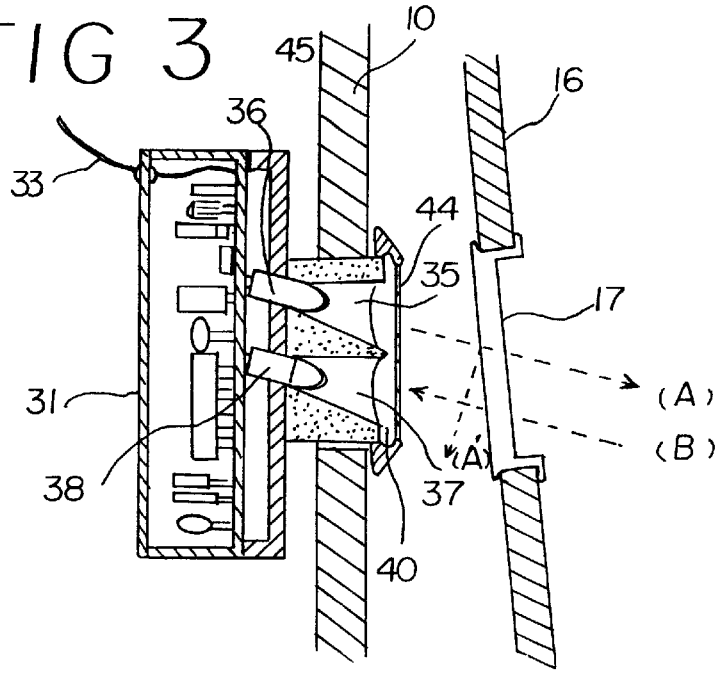
FIG. 3 is a cross-sectional view showing the position of the motion sensor member in the toilet tank for illustrating the construction thereof and showing the beam direction of the sensor according to the present invention.
Figure 4:
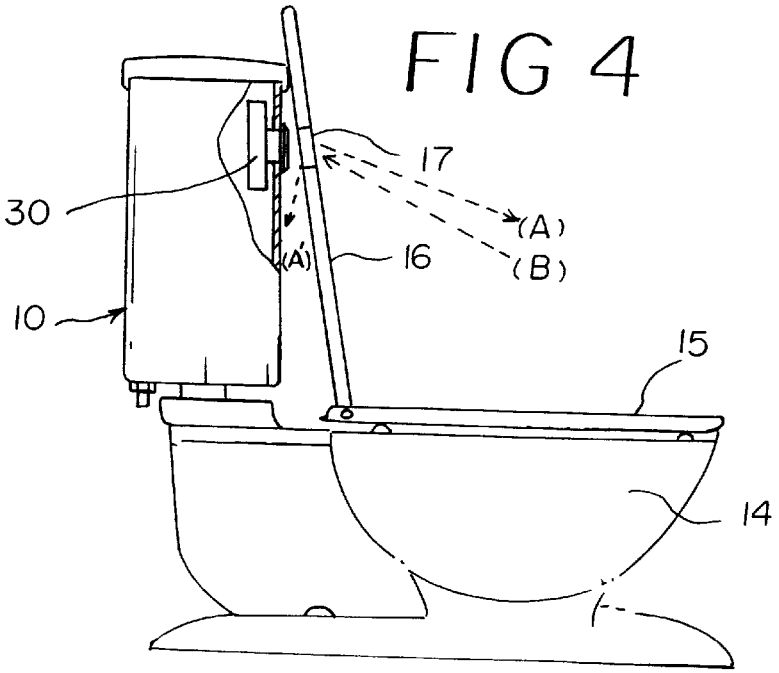
FIG. 4 is a side view of the toilet assembly having an automatic flushing system according to the present invention, containing cut-away portions in order to illustrate the motion sensor member disposed on the front interior wall of the water holding tank and showing the seat cover in an open position.

As shown in FIGS. 2, 3, and 4, the right and left recess chambers 35 and 37 have a downwardly oriented recess configuration, for sending a beam (A) from the sending eye 36 to the user of the toilet and receiving the beam (B) from the user to the receiving eye 38. Also, the convex lens 41 functions to collect the beam and prevent it from scattering.

Figure 6:
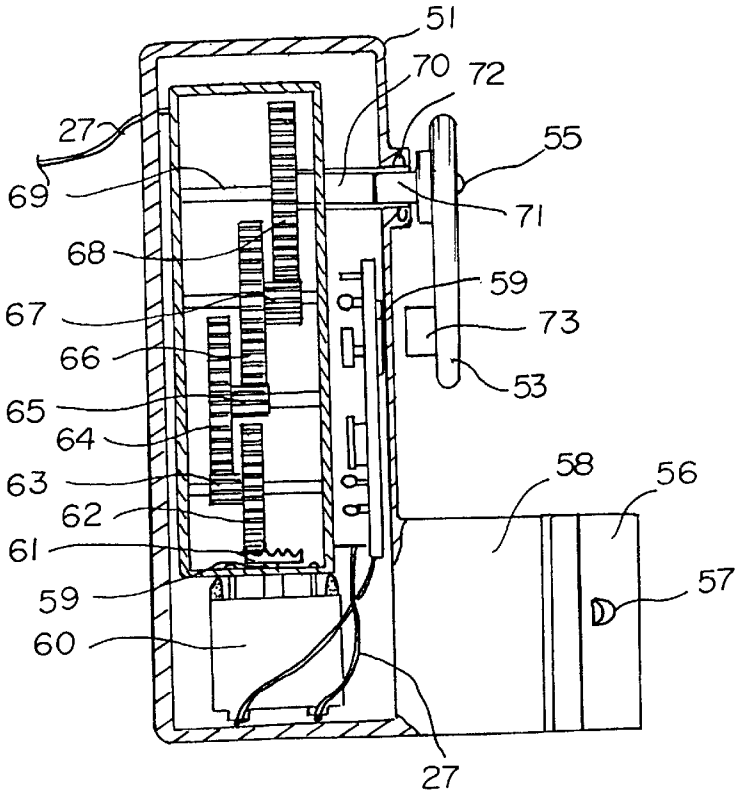
FIG. 6 is a sectional view of the lifting lever member of the toilet assembly according to the present invention.
Figure 5:
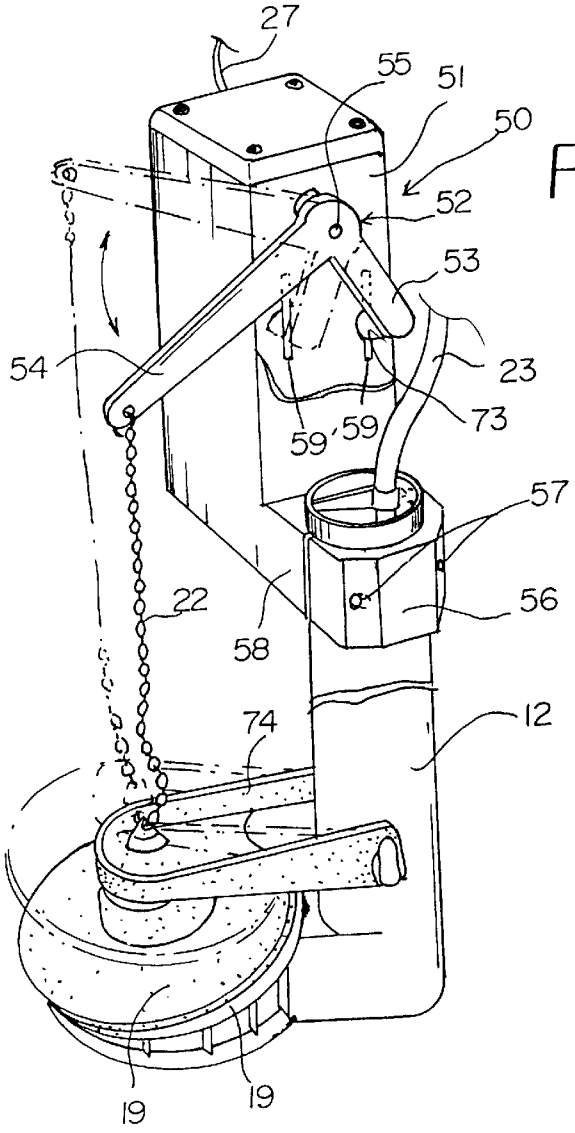
FIG. 5 is a perspective view showing a lifting lever member of the toilet assembly utilizing the automatic flushing system according to the present invention.

As shown in FIGS. 5 and 6, the lifting member 50 includes a lever housing 51 having a flange 58, and an L-shaped lever 52 having a short leg 53 and a long leg 54, which is pivotally attached to the lever housing 51 through a pivot 55. The flapper valve 19 is pivotally supported by a U-shaped support 74, and an engagement cap 56 is provided for attaching the lift member 50 to the overflow tube 12 by bolts 57. The flapper valve 19 is connected to the end of the long leg 54 of the L-shaped lever 52 by a chain 22 for allowing the flush water to discharge through the main tunnel 19' when the flapper valve 19 is in an open position.

Referring to FIG. 6, the lever housing 51 contains a motor 60 connected by the electric wire 27 to the terminal 26 of a battery 25 (FIG. 1) or an electric source (not shown), and a bevel gear 61 is coaxially connected to the motor 60. The bevel gear 61, a third gear 63, a fifth gear 65, and a seventh gear 67 are disposed in a geared relationship with a second gear 62, a fourth gear 64, a sixth gear 66, and an eighth gear 68, respectively. Therefore, the last gear, i.e., the eighth gear 68, has a reduced rpm with increased power. A shaft 69 of the eighth gear 68 provides a tubular half shaft 70 which connects with the nub 71 of the L-shaped lever 52 for attaching the nub 71 to the shaft 69 through an O-ring 72.

As shown in FIG. 5, the lever housing 51 contains a first magnetic relay switch 59 and a second magnetic relay switch 59' for determining the ON or OFF-position utilizing a magnet 73 attached to the short leg 53 of the L-shaped lever 52. The motor 60 is a two-way motor.

The toilet assembly having an automatic flushing system according to the present invention operates as follows.

If the toilet seat cover 16 is raised and if the motion sensors 36 and 38 are positioned in a straight position as evidenced by the prior art, at least a portion of the beams of the motion sensor 36 will reflect off of the window 17 and be received by the receptor sensor 38 whereby the toilet would never flush, even after the toilet has been used. However, according to the present invention as shown in FIG. 3, the motion sensors 36 and 38 are angled so that any reflection of the beam against the window will miss the receptor 38. In this situation, when the user moves away from the toilet seat 16, the receptor senses this movement and the toilet is automatically flushed. Accordingly, upon opening the toilet seat cover 16, when the user uses the toilet assembly and then leaves the toilet assembly, the motion sensor member 30 initiates a charge in the electric current to the motor 60. Therefore, the L-shaped lever rotates in the clockwise direction and the bevel gear 61 which is coaxially connected to the motor, gears with the second gear 62, the third gear 63, and the fifth gear 65 and the seventh gear 67 is geared with the fourth gear 64, the sixth gear 66, and the eighth gear 68, respectively.

At this time, the long leg 54 of the L-shaped lever 52 moves up as indicated by the dotted lines and arrows shown in FIG. 5, and the flapper valve 19 is open and the fresh flush water flows to the toilet bowl 14 from the toilet water holding tank 10 through the main tunnel 19'. At this time, when the short leg 53 containing a permanent magnet 73 adheres to the second magnetic relay switch 59' from the first magnetic relay switch 59, the motion sensor member 30 cuts the electric current to the motor 60 for a certain period of time, for example, five seconds, so that the flush water in the toilet water holding tank 10 is automatically flushed.

In turn, the motion sensor member 30 charges the electric current to the motor 60. At this time, the two-way motor 60 rotates in a counterclockwise direction, so that the L-shaped lever rotates in a counterclockwise direction. At this time, when the flapper valve 19 is in a closed position and the short leg 53 having the permanent magnet 73 adheres to the first magnetic relay switch 59 from the second magnetic relay switch 59', the motion sensor member 30 cuts the electric current, so that the L-shaped lever member 52 returns to its original position. The two-way motor 60 deactivates at this time.

The motion sensor member does not actuate when any object, such as a person passes near the toilet for only a short period of time, e.g. about 10 seconds. The reason for this is that when any object such as the human being moves quickly past the toilet, there is no need for the toilet assembly to flush.

As shown in FIG. 1, the electric source is a battery 25 disposed on the back interior of the water holding tank 10. Alternatively, the flush system can be directly connected to AC by electric wire 28 through a wire hole disposed on the back wall of the water holding tank 10.

FIGS. 3 and 4 show the seat cover 16 containing the sensor window 17, standing in an angled position, i.e., the seat cover 16 is in an open position, and the motion sensor eye 38 disposed in recesses 35 and 37, respectively, are angled in a downward orientation. Therefore, the sending beam from sensor 36 which reflects from window 17 is not received by the receiving eye 38. However, if the sending and receiving eyes 36 and 38 located in recess chambers 35 and 37 are in a straight position, as in the prior art, at least a portion of the sending beam from the sending eye 36 returns to the receiving eye 38, whereby flushing never occurs.

Accordingly, according to the present invention, the sending beam from the sending eye 36 is collected by the convex lens 40. A part of the beam (A) goes through the sensor window 17 and a part of the beam (A1) reflects from the sensor window 17, but is not received by the receptor 38 due to the angled position of the sensors 36 and 38.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toilet assembly having an automatic flushing system which comprises:

a toilet bowl having a toilet cover, said toilet cover containing a window disposed therein, a water holding tank connected to said toilet bowl, said holding tank containing operative means comprising means for storing water, discharging water into the toilet bowl and replenishing water to the water holding tank, and motion sensing means operatively connected to said operative means associated with the water holding tank and aligned with the window in the toilet cover, when said toilet cover is in a raised position, said motion sensing means being angled in a downward direction from the horizontal, so that any reflection of beams from the motion sensing means against the window in the toilet cover is not received by the motion sensor and thus does not activate the motion sensor.

2. The toilet assembly of claim 1, wherein the motion sensor has an element for sending beams and an element for receiving beams whereby the beams reflected from the window of the toilet cover are deflected so as not to activate the motion sensor.

3. The toilet assembly of claim 1, wherein a mechanism is provided within the water holding tank for performing the normal flushing function of the toilet system and refilling of the toilet bowl with water.

4. The toilet assembly of claim 3, wherein a manual flushing system is operatively connected to said flushing function of the toilet system.

5. The toilet assembly of claim 1, wherein the motion sensing means is provided with a convex lens for collecting the beam and preventing it from scattering.

6. The toilet assembly of claim 1, wherein the operative means includes a plurality of gears operatively interconnected with each other and with said water discharge means and said water replenishing means, said plurality of gears being driven by a motor which, in turn, is operatively connected with said motion sensing means.

7. The toilet assembly of claim 1, wherein a manual flush means is operatively connected with said operative means for manually operating the toilet assembly.

* * * * *